US005193839A

United States Patent [19]

Hannes

[11] Patent Number: 5,193,839

[45] Date of Patent: Mar. 16, 1993

[54] WINTER SPORT EQUIPMENT

[76] Inventor: Jacob Hannes, Köschenrütistrasse 77, CH-8052 Zurich, Switzerland

[21] Appl. No.: 751,643

[22] Filed: Aug. 26, 1991

Related U.S. Application Data

[63] Continuation of Ser. No. 453,670, Dec. 20, 1989, abandoned.

[30] Foreign Application Priority Data

Dec. 27, 1988 [CH] Switzerland ..... 4807/88

[51] Int. Cl.[5] ..... A63C 5/00

[52] U.S. Cl. ..... 280/600

[58] Field of Search ..... 280/600, 601, 603, 608, 280/609; 36/117, 122

[56] References Cited

U.S. PATENT DOCUMENTS

| | | | |
|---|---|---|---|
| D. 232,044 | 7/1974 | King | 280/600 |
| 2,946,599 | 7/1960 | Hunsbedt | 280/11.13 |
| 3,965,586 | 6/1976 | Roosli | 36/122 |
| 4,004,355 | 1/1977 | Koblick | 36/122 |
| 4,836,571 | 6/1989 | Corbisiero | 280/600 |

FOREIGN PATENT DOCUMENTS

| | | |
|---|---|---|
| 1943298 | 3/1971 | Fed. Rep. of Germany . |
| 1247018 | 10/1960 | France . |
| 604765 | 4/1978 | Switzerland . |
| 651478 | 9/1985 | Switzerland . |

*Primary Examiner*—Richard M. Camby
*Attorney, Agent, or Firm*—McAulay Fisher Nissen Goldberg & Kiel

[57] ABSTRACT

Sport equipment, for example in boot form, consists of a pair of sole plates, each having two gliding edges along its sides. To permit both gliding or skating steps and ordinary walking, the present invention provides for sole plates whose width increases from the toe end to the part for the ball of the foot and then remains the same to the heel end. The underside of the sole plate has a generally flat standing surface from the heel end to the part for the ball of the foot, and a walking surface that slopes up from there to the toe end. The heel end may be formed as a heel-brake skid and the toe end may be formed as a spade tip. The equipment may be made either in the form of boots, or as a pair of sole plates with suitable means of attachment to shoes or boots.

16 Claims, 2 Drawing Sheets

WINTER SPORT EQUIPMENT

This application is a continuation of application Ser. No. 453,670, filed Dec. 20, 1989, now abandoned.

FIELD OF THE INVENTION

The invention relates to winter sport equipment that permits gliding or skating steps by means of a pair of sole plates, each of which has two gliding edges along its sides.

BACKGROUND OF THE PRIOR ART

Proposals for sport equipment of a similar kind are already known, for example DE-OS 19 43 298, CH-PS 651 478, which is worn on the feet and is supposed to permit gliding or skating steps on snow-covered flat or sloping surfaces. However, such known equipment has to date not achieved a breakthrough, generally because the design of the sole plates inhibited smooth, flowing motion. Apparently, straight, parallel gliding edges running from the toe end to the heel end have been regarded as necessary, but in this known type of equipment the relatively wide front part of the sole prevents or makes it difficult to change step from one foot to the other, as in normal walking or, for example, in skating.

The present invention, therefore, attempts a further development of the type of winter sport equipment described, in such a way as to allow its ready use free from such limitations, in the most varied types of terrain and conditions, in the execution of gliding steps and including so-called skating steps on flat ground and swinging turns in descent, as well as normal walking.

SUMMARY OF THE INVENTION

The invention solves this problem by sole plates that increase in width from the toe end to the part for the ball of the foot, the width of the underside of the sole plates then remains the same to the heel end, wherein the underside of the sole plates has a walking surface which slopes up from a generally flat standing surface from the part for the ball of the foot to the toe end. This design has shown that it permits surprisingly harmonious and coordinated motion. The equipment is suitable equally for locomotion on ski pistes, for skating on flat ice surfaces, and for walking and gliding on snow-covered ground, roads, and sidewalks. It can be used for pleasure and sport training, and can be readily worn indoors.

The sole plate may form an integral part of a special boot, or may be made for attachment to an ordinary boot or shoe by straps, buckles, or similar means.

Examples in the form of boots of embodiments of the winter sport equipment to which this invention relates are described below in conjunction with the drawings attached hereto, wherein only one boot of the pair is shown in each case.

DESCRIPTION OF THE PREFERRED EMBODIMENTS

Figure 1:
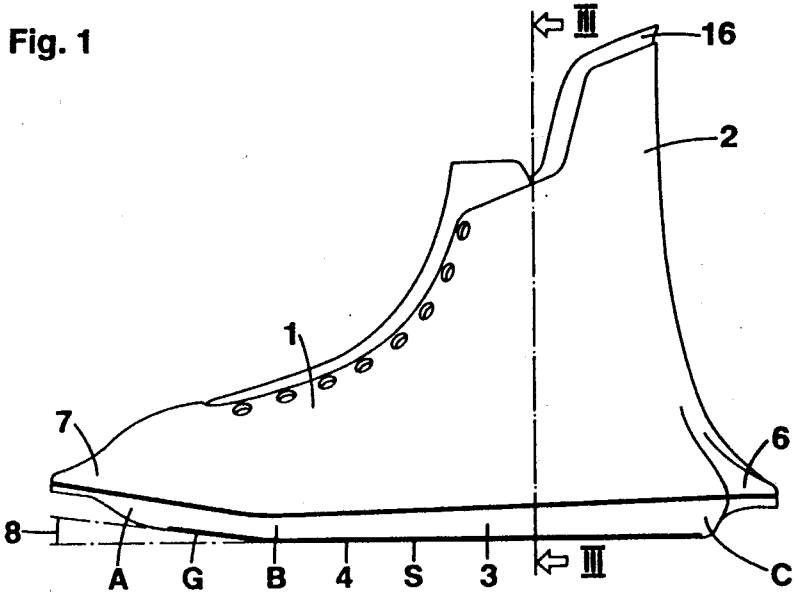
FIG. 1 shows a first embodiment in side elevation.

The winter sport boot in accordance with FIGS. 1 to 4 consists generally of uppers 1, having a shaft 2, and a sole plate 3. These parts are preferably made of injection-moulded synthetic material. Known methods may be used to make a one-piece moulding comprising the uppers and sole plate or, as shown in the drawing, other known methods may be used to make the uppers and sole plate as separate pieces that are later firmly connected to each other.

The shape of the two lateral gliding edges of the sole plate is of special importance. As shown in the plan view, FIG. 2, the width of the sole plate 3 increases from the toe end of the boot A to the part for the ball of the foot B, which accommodates the widest part of the foot, and from said part for the ball of the foot B the width remains the same all the way to the heel end C, i.e. the lateral edges of the sole plate in this part of the boot are parallel. The underside of the sole plate 3 forms a generally flat standing surface S which extends from the heel end C under the heel bed 17 as far as the part for the ball of the foot B. Adjacent to the standing surface S is the area G that may be designated as the walking surface, which slopes up from the standing surface S from the part for the ball of the foot B to the toe of the boot A, as indicated by angle 8. This angle should preferably be about 6° to 10°. The walking surface which slopes in this manner greatly facilitates the rolling type of motion required of the sole plate when used for walking, even if longitudinally the sole plate is relatively stiff, and glides readily over obstacles such as small hummocks etc when used for a longitudinal gliding movement. Along the gliding edges of the sole plate 3, gliding profiles 4 of hard-wearing material such as hardened steel should preferably be fitted and, as shown, these should extend forward from the heel end C beyond the part for the ball of the foot B and be bent accordingly. On the underside of the sole plate 3, one or more longitudinal grooves may be provided, extending along the standing surface S and the walking surface G. The entire underside or parts thereof may also have a scaly and/or ribbed texture to improve ground adhesion for walking and to prevent unintentional skidding.

The boot as shown has a spade tip 7 which projects forward beyond the toe end A, and a heel-braking skid 6 which projects to the rear beyond the heel end C; at least the heel-braking skid 6 is raised above the standing surface S of the underside of the sole plate. The heel-braking skid 6 and the spade tip 7 should preferably be beak-shaped as shown, the beak being permanently formed by the boot's sole plate and its uppers, but the projecting parts 6 and 7 may also be formed only by one of the two said parts of the boot, i.e. its sole plate or its uppers.

Figure 2:
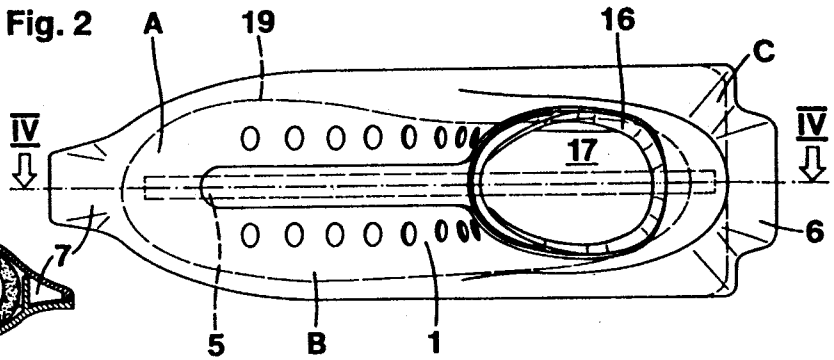
FIG. 2 is a plan view of FIG. 1.

The inside of the uppers 1 of the boot with the shaft 2 is fitted with an inner boot or padding 16, thus ensuring adequate comfort to the wearer even when the equipment is used for sporting activities. A suitable constructional design of the bed for the foot is described in greater detail below, in conjunction with FIG. 8. As shown in FIGS. 2 (foot bed shown in dashed lines) and 3, the sole plate 3 projects some way at the sides and rear beyond the heel bed 17, because the heel bed 17 is considerably narrower than the part of the boot for the ball of the foot B which has to accommodate the widest part of the foot. It is advisable to make adequate provision in the region surrounding the heel bed 17 for a satisfactory transfer of forces from the shaft 2 to the sole plate 3, for example as shown in FIG. 3, by making the shaft so that it widens continually to the edge of the sole plate.

Figure 5:
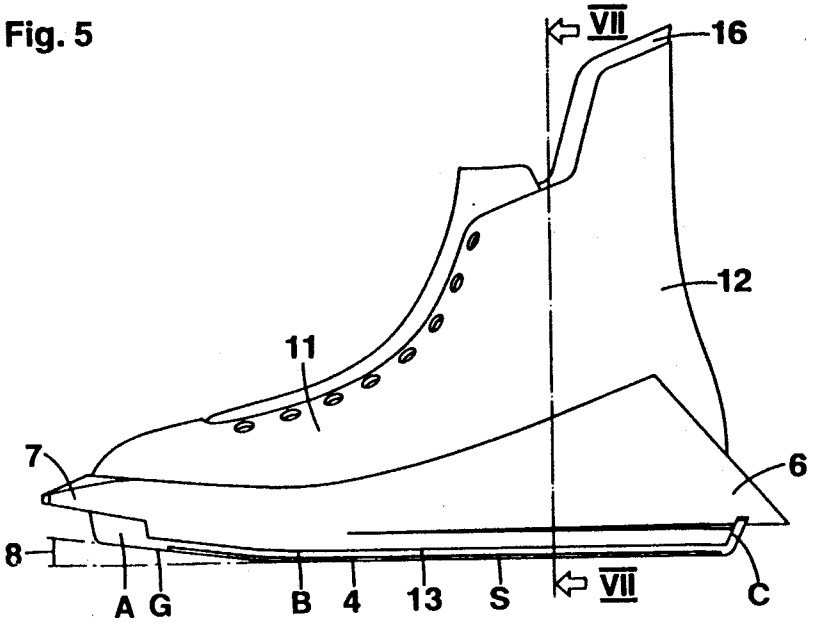
FIG. 5 shows a further embodiment in side elevation.
Figure 6:
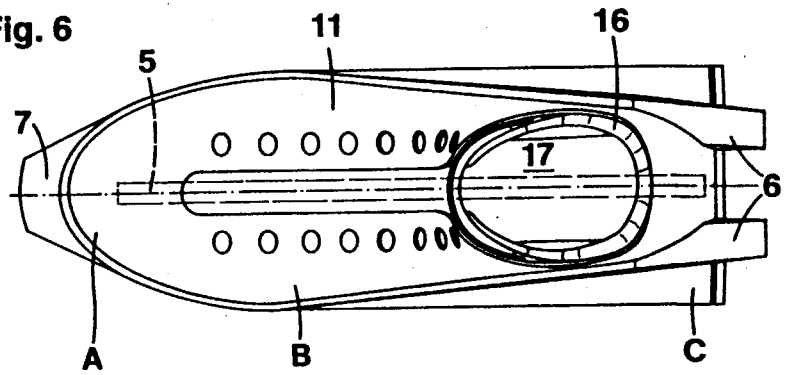
FIG. 6 is a plan view thereof.

The boot in accordance with the embodiment shown in FIGS. 5 to 7 again consists of a sole plate 13 and uppers 11 with a shaft 12. The other parts which correspond to those shown in FIGS. 1 to 4 are identified by the same reference numbers, and the descriptions of their design and function given above in connection therewith also apply to them here. A mainly external difference is the shape of the spade tip 7 to the toe and the alternative design shown here for the heel end C, which in this case consists of a pair of heel-braking skids 6.

Figure 7:
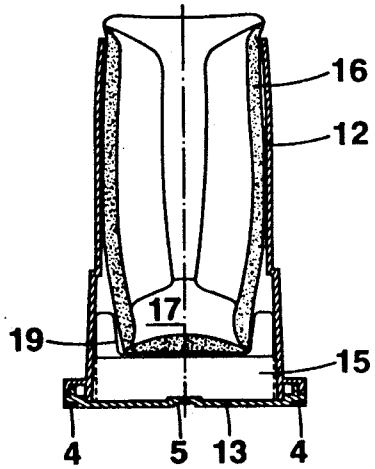
FIG. 7 is a section along line VII—VII in FIG. 5.

The foot bed 19 on the line of the section through the heel bed 17 is shown in FIG. 7. The shape of the foot bed 19 may be defined by a large number of parallel vertical cross-ribs standing up from the sole plate 13. In the example shown in FIGS. 5 to 7, such cross-ribs may be part of a one-piece moulding formed with the sole plate 13, and FIG. 7 shows one of these ribs 15 in elevation.

Figure 3:
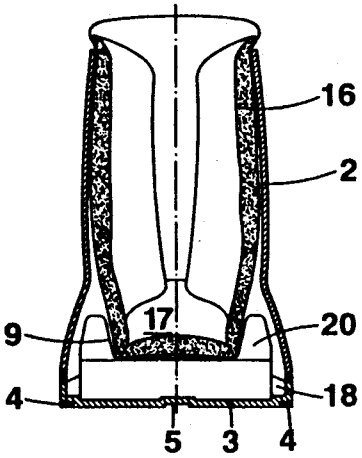
FIG. 3 is a section along line III—III in FIG. 1.
Figure 4:
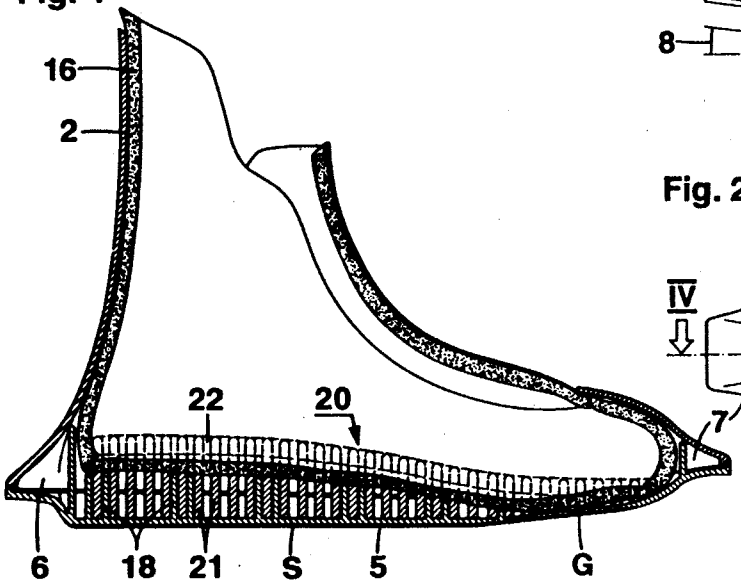
FIG. 4 is a longitudinal section along line IV—IV in FIG. 2.
Figure 8:
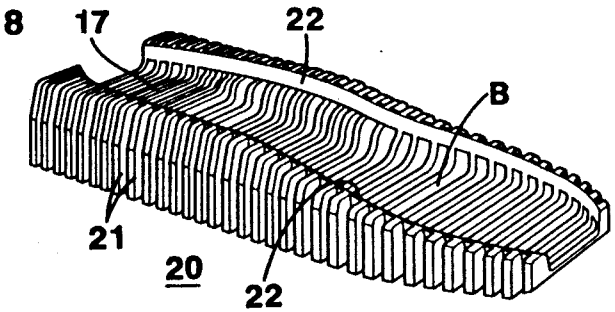
FIG. 8 is a perspective view of a bed for the foot, formed as a removable, interchangeable insert for a boot in accordance with FIGS. 1 to 4.

FIGS. 3, 4, and 8 show a suitable alternative construction of the foot bed 19, which may be an interchangeable insert 20, wherein a large number of cross-ribs 21 are connected to each other, for example by two longitudinal webs 22, as shown in FIG. 8. Such inserts 20 may be prefabricated as foot beds for a variety of shapes and sizes of feet. In the manufacture of the boot, the appropriate insert is placed on the sole plate 3. On the upper surface of the sole plate shown in FIG. 4, a number of vertical cross-ribs 18 are formed at fairly large intervals, each of which grips between two cross-ribs 21 of the insert, and prevents the insert and the foot bed sliding about inside the boot. The comb-like construction of the foot bed gives the sole plate the requisite longitudinal flexibility and high transverse stability. At the same time, this type of construction provides the sole of the boot with an efficient means of thermal insulation.

The winter sport equipment to which this invention relates may be made as boots, as described, or simply as a pair of sole plates, each plate being attached to a shoe or boot by suitable means, such as straps, buckles, snap fastenings, or other such or similar means.

While the foregoing description and drawings represent the preferred embodiments of the present invention, it will be obvious to those skilled in the art that various changes and modifications may be made therein without departing from the true spirit and scope of the present invention.

What is claimed:

1. Winter sport equipment to be worn on the feet of a user which permits gliding or skating steps of varying degrees of complexity, said equipment comprising:

a pair of sole plates, each sole plate having two gliding edges along sides thereof, said gliding edges including hard-wearing material for maintaining said edges, each sole plate having a width which increases from a toe end to substantially a part for the ball of a foot and which width remains substantially the same from said ball part to a heel end, each sole plate having an underside which includes a walking surface which slopes upwardly from a generally flat standing surface substantially from the part for the ball of the foot to the toe end;

wherein each sole plate is constructed as a unitary plate, having virtually straight side edges along the flat standing surface, said side edges for providing control of said equipment during use, and wherein the entire portion of the sole plate behind the part of the region for the ball of the foot is generally flat; and wherein means are included for removably connecting each sole plate with an upper portion of a boot, said sole plate and boot upper portion forming an integral structure for gliding and skating.

2. Winter sport equipment to be worn on the feet of a user which permits gliding or skating steps of varying degrees of complexity, said equipment comprising:

a pair of sole plates, each sole plate having two gliding edges along sides thereof, said gliding edges including metallic inserts for maintaining said edges, each sole plate having a width which increases from a toe and to substantially a part for the ball of a foot and which width remains substantially the same from said ball part to a heel end, each sole plate having an underside which includes a walking surface which slopes upwardly from a generally flat standing surface substantially from the part for the ball of the foot to the toe end;

wherein each sole plate is constructed as a unitary plate, having virtually straight side edges along the flat standing surface, said side edges for providing control of said equipment during use, and wherein the entire portion of the sole plate behind the part of the region for the ball of the foot is generally flat; and wherein means are included for removably connecting each sole plate with an upper portion of a boot, said sole plate and boot upper portion forming an integral structure for gliding and skating.

3. Winter sport equipment to be worn on the feet of a user which permits gliding or skating steps of varying degrees of complexity, said equipment comprising:

a pair of sole plates, each sole plate having two gliding edges along sides thereof, each sole plate having a width which increases from a toe end to substantially a part for the ball of a foot and which width remains substantially the same from said ball part to a heel end, each sole plate having an underside which includes a walking surface which slopes upwardly from a generally flat standing surface substantially from the part for the ball of the foot to the toe end;

wherein each sole plate is constructed as a unitary plate, having virtually straight side edges along the flat standing surface, said side edges for providing control of said equipment during use, and wherein the entire portion of the sole plate behind the part of the region for the ball of the foot is generally flat except for a shallow channel along the longitudinal axis of the sole plate; and wherein means are included for removably connecting each sole plate with an upper portion of a boot, said sole plate and boot upper portion forming an integral structure for gliding and skating.

4. Winter sport equipment to be worn on the feet of a user which permits gliding or skating steps of varying degrees of complexity, said equipment comprising:

a pair of sole plates, each sole plate having two gliding edges along sides thereof, each sole plate having a width which increases from a toe end to substantially a part for the ball of a foot and which width remains substantially the same from said ball part to a heel end, each sole plate having an underside which includes a walking surface which slopes upwardly from a generally flat standing surface substantially from the part for the ball of the foot to the toe end;

wherein each sole plate is constructed as a unitary plate, having virtually straight side edges along the flat standing surface, said side edges for providing control of said equipment during use, and wherein the entire portion of the sole plate behind the part of the region for the ball of the foot is generally flat; and wherein means are included for removably connecting each sole plate with an upper portion of a boot, said sole plate having an upwardly extending portion at the toe end, said portion having a shoulder, for interfitting with a corresponding portion of said boot upper portion, said sole plate and boot upper portion forming an integral structure for gliding and skating.

5. In winter sport equipment to be worn on the feet of a user which permits walking, gliding and skating steps of varying degrees of complexity having an upper portion in the form of a top of a boot and a gliding portion removably attachable to said boot top portion, the improvement comprising:

that said removable gliding portion is in the form of a plate-like sole for said boot top portion having a width which increases from a toe end to substantially a part for the ball of a foot, the width of said sole remaining substantially the same from said ball part to a heel end, said sole having an underside which includes a walking surface which slopes upwardly from a generally flat standing surface substantially from the part for the ball of the foot to the toe end; and that said sole has side edges along the flat standing surface whereby the shape of the toe end of a combined top boot portion and sole enables walking, whereby said flat standing surfaces enables standing, skating and gliding and whereby said edges enable turning and ski-like movement.

6. Winter sport equipment to be worn on the feet of a user which permits gliding or skating steps of varying degrees of complexity, said equipment comprising:

a pair of sole plates, each sole plate having two gliding edges along sides thereof, each sole plate having a width which increases from a toe end to substantially a part for the ball of a foot and which width remains substantially the same from said ball part to a heel end, each sole plate having an underside which includes a walking surface which slopes upwardly from a generally flat standing surface substantially from the part for the ball of the foot to the toe end;

wherein each sole plate is constructed as a unitary plate, having virtually straight side edges along the flat standing surface, said side edges for providing control of said equipment during use, and wherein the entire portion of the sole plate behind the part of the region for the ball of the foot is generally flat; and wherein each sole plate is fixedly connected with an upper portion of a boot, said sole plate and boot upper portion forming an integral structure for gliding or skating.

7. Winter sport equipment to be worn on the feet of a user which permits gliding or skating steps of varying degrees of complexity, said equipment comprising:

a pair of sole plates, each sole plate having two gliding edges along sides thereof, each sole plate having a width which increases from a toe end to substantially a part for the ball of a foot and which width remains substantially the same from said ball part to a heel end, each sole plate having an underside which includes a walking surface which slopes upwardly from a generally flat standing surface substantially from the part for the ball of the foot to the toe end;

wherein each sole plate is constructed as a unitary plate, having virtually straight side edges along the flat standing surface, said side edges for providing control of said equipment during use, and wherein the entire portion of the sole plate behind the part of the region for the ball of the foot is generally flat; and wherein means are included for removably connecting each sole plate with an upper portion of a boot, said sole plate and boot upper portion forming an integral structure for gliding and skating.

8. The winter sport equipment of claim 6 or claim 7 wherein the edges of each sole plate along the flat standing surface are substantially parallel to each other.

9. Winter sport equipment to be worn on the feet of a user which permits gliding or skating steps of varying degrees of complexity, said equipment comprising:

a pair of sole plates, each sole plate having two gliding edges along sides thereof, each sole plate having a width which increases from a toe end to a part for the ball of a foot and which width remains the same from said ball part to a heel end, each sole plate having an underside which includes a walking surface which slopes upwardly from a generally flat standing surface from the part for the ball of the foot to the toe end; and wherein each sole plate is constructed as a unitary plate, having virtually straight edges and wherein the entire portion of the sole plate behind the part of the region for the ball of the foot is generally flat;

wherein each sole plate is fixedly connected with the upper portion of a boot, said upper portion of said boot including a foot bed having a shape defined by a large number of parallel vertical cross-ribs extending upwardly from the sole plate, said cross-ribs being connected with each other and forming a removable, interchangeable insert.

10. Winter sport equipment in accordance with claim 6 or claim 7, wherein gliding profiles made of hard-wearing material are fitted along the gliding edges and extend forward from the heel end beyond the part for the ball of the foot.

11. Winter sport equipment in accordance with claim 6 or claim 7, wherein the underside of each of the sole plates includes at least one longitudinal groove extending over the standing surface and walking surface.

12. Winter sport equipment in accordance with claim 6 or claim 7, wherein the underside of each of the sole plates has a scaly and/or ribbed texture.

13. Winter sport equipment in accordance with claim 6 or claim 7, wherein at least one heel-brake skid is included which is set higher than the standing surface and projects backward beyond it.

14. Winter sport equipment in accordance with claim 6 or claim 7, wherein a spade tip is included which projects forward beyond the toe end.

15. Winter sport equipment in accordance with claim 6 or claim 7, wherein said upper portion of said boot includes a foot bed having a shape defined by a large number of parallel vertical cross-ribs extending upwardly from the sole plate.

16. Winter sport equipment in accordance with claim 7, wherein a number of vertical cross-ribs form part of a one-piece moulding with the sole plate, each of which grips two of the insert's cross-ribs.

* * * * *